United States Patent [19]

Bradley

[11] 4,052,298

[45] Oct. 4, 1977

[54] TREATMENT OF ELECTROPHOTOGRAPHIC TONER COMPOSITIONS

[75] Inventor: Edward T. Bradley, Caledonia, Wis.

[73] Assignee: Colorkrome, Inc., Traverse City, Mich.

[21] Appl. No.: 527,485

[22] Filed: Nov. 26, 1974

[51] Int. Cl.[2] ..... B03B 1/00; B03D 3/06

[52] U.S. Cl. ..... 209/5; 106/309; 210/43

[58] Field of Search ..... 209/5; 210/43; 106/309

[56] References Cited

U.S. PATENT DOCUMENTS

| | | | |
|---|---|---|---|
| 932,548 | 8/1909 | Hopkins | 106/309 |
| 1,585,755 | 5/1926 | Borcherdt | 209/5 X |
| 1,819,462 | 8/1931 | Grossman | 210/43 |
| 2,271,324 | 11/1942 | Yee | 106/309 X |
| 2,403,143 | 7/1946 | Tuit | 210/43 X |
| 2,982,635 | 5/1961 | Dille | 210/43 X |
| 3,432,030 | 3/1969 | Olivier | 209/5 |
| 3,712,824 | 11/1973 | Kiyokowa | 106/309 |

FOREIGN PATENT DOCUMENTS

| | | | |
|---|---|---|---|
| 1,083,192 | 3/1958 | Germany | 209/5 |

*Primary Examiner*—Frank W. Lutter
*Assistant Examiner*—Frank Sever
*Attorney, Agent, or Firm*—Price, Heneveld, Huizenga & Cooper

[57] ABSTRACT

Electrophotographic toner compositions, particularly concentrates, are emulsified in water; then subject to pigment and associated charged body material extraction by a mineral spirit liquid which is rich in charge control agent; after which separation the emulsified composition and the extracted pigment material are individually recovered for re-use or other desired disposition.

15 Claims, No Drawings

TREATMENT OF ELECTROPHOTOGRAPHIC TONER COMPOSITIONS

BACKGROUND AND STATEMENT OF INVENTION:

The present invention pertains to the separation and recovery of electrophotographic toner compositions, particularly concentrates, to effectively and efficiently isolate the pigment and associated charged body material therein for reclamation and re-use (or other desired disposition on an individual basis(;) and the objects and aims of the invention are to provide an advantageous and beneficial treatment and technique for accomplishment of the indicated purpose(s).

Change-responsive dye or pigment colorants (which includes black), generally called "toners", are well known in the electrophotographic art for developing and fixing in black-and-white or plural color reproductions the latent images imposed by activating influences, such as light, on sensitized and exposed image-retaining electrophotographic base materials. The electrophotographic phenomenon for both the so-called line copy and actual pictorial reproduction is well known in the art. Amongst the copious patent and literature material available thereon, reference may be had to U.S. Pat. Nos. 3,052,539; 3,249,430; 3,259,581; 3,383,209; 3,595,691; 3,660,086; 3,751,247; 3,758,305; 3,802,880; and 3,809,555 and the numerous citations therein amongst the multitudinous additional teachings and disclosures available in the art (such as those included, inter alia, in International Search Classes G03f, G03g and so forth). A good standard reference in the electrophotographic field is "*Xerography And Related Processes*" by Dessauer and Clark, 1965 Edition, published by Focal Press. Various electrophotographic base materials and colorants, as well as other more specialized teachings and disclosures, may in addition to the above be discerned in U.S. Pat. Nos. 2,891,911; 3,078,231; 3,249,430; 3,259,581; 3,296,140; 3,639,243; 3,639,244; 3,802,880; 3,804,619; and 3,809,555 plus Canadian Pat. Nos. 846,740; 846,741 and 846,742. Thus, no further fundamental elucidation or detailed description is necessary or required as to same for full comprehension and clear understanding of the present invention.

In general, toner colorants are pigments or dyestuffs (or combinations thereof) that are coated with usually a plastic or resinous binder and dispersed in a suitable mineral spirit or normally liquid hydrocarbon material from petroleum or the like with (although other additives of a charge-responsive nature or having other desired characteristics may also be present) a very minor proportion — almost in trace quantities on the order of 1 - 1,000 ppm by wt. and more often between about 10 and 50 ppm — of charge control or directing agents which tend to direct and accurately control good deposition and lay-down of the colorant during latent image development and fixing.

As with the pigments or dyestuffs and resin binders therefor, many of a wide variety of suitable charge control agents are suitable for use in toner compositions. Typical of these are cobalt naphthanate, manganese octosol, (scientifically boiled) linseed oil, asphaltum, ollyl acid phosphate and the like and equivalent materials. As is above indicated, the toners generally employ only literal trace amounts of the charge control agent(s), with maximum ranges involved for at least rough comparison with those above specified in ppm being, on a wt. % based on total solids in the toner, between about 0.1 or 0.15 to 0.3 or 0.4%.

Many of a wide variety of organic and inorganic pigments and/or dyestuffs may be utilised as the colorant in the toner including such materials as various carbon blacks; asphaltums; specific and oftentimes proprietary materials such as the colorants "Phthalocyanine Blue", "Rhodamine B", "Benzidine Yellow" and so forth; various oxides, sulfates, sulfides, carbonates, phosphides, phosphates, nitrates, nitrites and the like of alkali metals, alkaline earth metals, a large number of the heavy metals and, frequently, organic derivatives of the straightforward inorganic pigment colorants; and so forth. Likewise, in order to obtain satisfactory coated pigment and/or dyestuff materials for toner colorant usage, many of wide variety of usually resinous or plastic (most often thermoplastic and fusible) binder materials can be employed including, for purposes of illustration, various vinyl resins, regular and modified arcylic resin polymers, methacrylates (including the methyl, methyl/n-butyl, ethyl, butyl, etc., varieties), regular and modified alkyd resin types, vinyl acetate polymers, vinyl butyral polymers, and so forth. Usually, the pigment to binder ratio in a toner colorant is such that there is between about 2 and about 10, more commonly 6 - 8, parts by weight of binder(s) to each part by weight of the pigment or dyestuff in the composition (with mixed pigment and/or dyestuff as well as mixed resin binder systems being possible to utilize); with the total solids dispersed in the vehicle ordinarily, on a % by wt. basis, no more than in the range of 0.2 to 1.5% taken on total toner composition with solids in the range between about 0.3 and about 1.1% by wt. being more typical.

Of course and as has been indicated, toner concentrates treated and in practice are those toner compositions which are prepared wherein the resin coated colorant with other additives combined is made up for subsequent dispersion in the desired solvent at the appropriate desired concentration for toner usage.

A predominantly aliphatic type normally liquid hydrocarbon mineral spirit or oleaginous material is frequently employed as the solvent or vehicle in the toner concentrate composition. An especially desirable solvent for the toner concentrates is an inert, highly dielectric, paraffinic oleaginous material (generally derived from petroleum stocks although synthesized equivalents may be utilized) of the type frequently employed as a transformer oil which has viscosity and gravity characteristics at least approximately, if not generally, in the range of those exhibited by motor oils for internal combustion and other engines between about 10W and 40W according to S.A.E. standards. Toner concentrates are capable of being prepared and handled with an advantageous economy of bulk or volume, and generally have desirably long storage and shelf-life properties, until actual preparation therefrom of the toner to be utilized therefrom.

When toner concentrates are dispersed (or diluted) to provide actual practical toner compositions, a wide variety of solvents may be utilized for the purpose. Good illustrations of these are the paraffin and isoparaffin types and varieties, such as those in the approximate $C_{16}$ range and which are known and avaiable under such trade designations are "Isopar G"; "Isopar H"; "Shell Sol 70"; and "Shell Sol 71", although sometimes solvents with such constituents as the aromatic mineral spirits may be employed, including such commercially available material as "Solvesso 100". It is ordinarily desirable for the mineral spirit solvent employed for dilution of the toner concentrate, however, to contain not more than about 10 wt. %, preferably less than 5% by wt., of aromatic constituent in the toner composition and for it to have a solubility parameter range according to the well-known and conventional concept on the numerical order between about 4 to 15, especially in the more narrow area between about 6 and 10.

On development and fixing of latent images in electrophotographic processes, toner compositions usually are considered to become more or less ineffective and spent or depleted when about ½ or so of the original solids content (as may be provided from a concentrate utilized for the toner preparation) is deposted out of the composition as a colorant for the electrophotographic copy reproduction(s) being made; this consideration being of course applicable to liquid toner systems. In the case of pictorial (rather than line copy) reproductions, this can happen as quickly as the 5th or so print of approximate maximum 5 inches × 7 inches reproduction using a toner bath volume of about 1,000 cc's. with a solids concentration in a given toner on the order of 0.7 wt. % of involved composition.

While concentrate may be added to a depleted toner in order to reconstitute or recondition and refresh it to its original position of colorant depositing capacity, this is not always desirable or easy to perform since in the process of toner depletion there tends to be a non-uniform utilization of toner ingredients (besides the colorant pigment and/or dyestuff) and proper adjustment without resort to or indulgence in possibly difficult analytical control techniques may be difficult in order to avoid undesirable imbalances of constituents, particularly charge control agent which can leach out the resin binder when present in too large or too small proportions, so as to preclude optimum operability and performance of the toner. Thus, excess quantities prepared in advance of toner concentrate greater than those actually required for toner preparation are not always utilizable or consumable in any desirable or practical way and, oftentimes with great advantage, are recovered according to the present invention.

Furthermore, toners are generally difficult to separate into original components especially on an economical and practically useful and attractive basis. Hence, the usual practice with toner composition concentrates incapable of practical utilization is to simply discard them as waste, since (because of their particular composition) they tend to have very limited, if any, diverse applicability and utility despite the fact that their original components can be employed for many things.

FURTHER SPECIFICATION AND DETAIL

Practice of the present invention to achieve its obvious desiderata and benefits and advantages involves a treatment or technique with toner concentrates that have been made up but find no potential for application according to a processing method comprising the general steps of: (i) taking a toner concentrate of the electrophotographic grade and type containing ordinarily resin or plastic coated pigment or dyestuff colorants material with other charge-responsive additives and/or bodies or materials contained therein and associated therewith which are dispersed and based in, as a solvent or vehicle therefor, a normally liquid, aliphatic, oleaginous hydrocarbon or mineral spirit solvent or vehicle, said toner concentrate being desired to be separated substantially if not completely into at least its basic compositional components; (ii) dispersing or emulsifying the toner concentrate in water generally on the order of about 1 to 20 or more, but preferable around 10 or so parts by weight or volumes of the toner concentrate to each part water employed using enough (as can easily be determined upon simple test by anyone skilled in the art) emulsifying agent or dispersing agent, such as the common and widely employed detergent materials of the non-ionic, anionic or cationic varieties, to disperse and/or emulsify the generally hydrophobic toner composition in and/or with the water; (iii) adding, with practically if not completely, no physical agitation or mixing, from about 0.25 to about 5 wt. % on a broad range but, more advantageously, between about 0.5 and about 1 wt. %, based on resulting composition or total ingredient weight, of a normally liquid aliphatic, aromatic or mixed aliphatic/aromatic hydrocarbon mineral spirit solvent or vehicle which is very rich in charge control agent — usually in a concentration based on composition weight of from, say, 1 to 10 or so, advantageously between about 5 and about 7, wt. %; (iv) allowing, without substantial, if any, agitation or mixing the added, extractant charge control agent-rich mineral spirit solvent or vehicle to attract the charge-responsive colorant and other associated materials to it so as to have a substantially, if not entirely, complete association thereabout of said extracted material in and from the toner concentrate (which usually occurs as a clustering or agglomeration of the colorant material about the charge control agent-rich mineral spirit additive) so as, in effect, to strip the charge-responsive colorant and associated material from the toner concentrate leaving therein essentially only the emulsified solvent from the original toner concentrate; then (v) physically separating, preferably by decantation or skimming or like procedure (wherein mixing or interblending is avoided to the greatest possible extent) the purposely kept immisced pigment or dyestuff colorant and associated charge-responsive material associated by predominant agglomeration and clustering-effects around and about, with little if any actual penetration into or absorption by, the extractant solvent from the de-coloranted toner concentrate mass; and subsequently and separately (vi) recovering the mineral spirit values and constituents from the colorant-freed and extracted emulsified former-toner concentrate mass and (vii) recovering, reusing and/or discarding the stripped colorant constituent contained about and/or with the charge control agent rich extractant mineral spirit mass.

Ordinary distillation or stripping techniques can be employed to regain the solvent from the colorant-freed emulsified portion of the recovered materials after separation; the solvent then being reusable in and for any suitable purpose or application.

To some extent, the same can be done with the extractant solvent, although quite often the colorant causes a problematical residue when distillation procedures are employed. If desired, the extractant solvent and extracted colorant material can be reused for toner composition if careful analysis is made of the composition so that ingredients (especially charge control agent) are finally obtained in proper proportions any new toner made from the recovered colorant material, with generally the most critical part about that being level of charge control agent. Especially by use of colorometric analytical techniques, it is possible to achieve such toner compositions based on the recovered colorant materials. However, unless it is desired to merely discard the recovered colorant material, it is oftentimes useful regardless of content of other additive materials for such applications as paint formulations, coloring agents for plastics and other color-blendable materials and so forth.

To specifically illustrate practice of the present invention, about 20 cc's of a toner concentrate composition containing roughly 0.7 wt. % dispersed colorant ("Benzidine Yellow") and other associated charge-responsive and charge-response-assisting materials was first emulsified with, using for the purpose, about 30 drops of "Lux" liquid dishwashing detergent obtained as the ordinary commercial-available product from Lever Bros. Company in New York; after which about 50 cc's. of water was added to the emulsification. After the completion emulsification, about 2 cc's. of a 6 wt. % solution of cobalt naphthanate in "Isopar G" was floated, with no mixing agitation, on the surface of the emulsified toner concentrate. Thus, the charge control agent-rich solvent actually contained about 0.12 gms. of the cobalt naphthanate. Immediately upon addition of the extractant solvent composition, the colorant from the emulsified toner concentrate began to cluster, with little if any at least visibly perceptible penetration, about the droplets of cobalt naphthanate-containing extractant solvent. Within an hour or so, practically all of the colorant was so collected about the extractant solvent; after which the conglomeration if extractant solvent and colorant was simply dipped away from the remainder of the originally emulsified toner concentrate. The solvent from the extracted material was recovered for re-use. The extracted colorant/extractant solvent material was in condition for any application intended to be made of it, although in the illustrated case it was simply discarded since no real demonstration of its utility was necessary.

Analogous results were obtained when the foregoing was repeated, excepting to utilize about 25 cc's. of the cobalt naphthanate-rich extractant solvent.

Equivalent results are also obtained with toner concentrates comprised of other colorants, such as "Diarylid Yellow", and so forth, as well as with other involved mineral spirit solvent vehicles and other charge control agents all pursuant to and in keeping with practice of the present invention.

As is readily apparent and will be appreciated by those skilled in the art, many changes and modifications can be easily and without extraordinary effort made and adapted in embodied techniques and practices in accordance with the present invention and without substantially departing from its intended spirit and scope, all pursuant to and in accordance with the same as it is set forth and defined in the claimed subject matter appended hereto.

What I claim and desire to secure in Letters Patent is:

1. Method for separating mineral spirit solvent vehicle constituents from charge-responsive colorant constituents in electrophotographic quality, normally liquid hydrocarbon mineral spirit-based toner compositions containing said charge responsive colorant constituents, which are resin binder coated colorant materials, dispersed in the solvent vehicle, said charge response colorant constituents being responsive to attraction by electrical charge so as to deposit on a sensitized and exposed latent image retaining electroconductive base material whereby the image is fixed and developed in the base, which method comprises the steps of:

i. uniformly dispersing said toner in water to form a dispersion;

ii. introducing generally onto the surface of said dispersion, without substantial physical intermixing, a quantity of an extractant mixture comprising a normally liquid hydrocarbon mineral spirit which contains between about 1.0 to about 10.0 wt. % of a conventional charge control agent of the type utilized in liquid toners;

iii. contacting said quantity of an extractant mixture, without substantial intermixing, with said dispersion for a time sufficient for at least a portion of the charge-responsive colorant constituent in the toner to be attracted to said quantity of an extractant mixture by substantially agglomerating and clustering in close physical proximity thereabout at the interface of the water and dispersed solvent and extractant liquid, thereby forming a colorant constituent agglomeration;

iv. physically separating said colorant constituent agglomeration and extractant mixture associated therewith from that which remains of said dispersion.

2. The method of claim 1, wherein in said Step (i) said toner concentrate composition is dispersed in between about 5% and about 100% of its own weight in water using a sufficient quantity of emulsifying detergent to assist in and maintain the dispersion.

3. The method of claim 2, wherein the extractant mixture added pursuant to said Step (ii) comprises between about .25 and about 5 wt. % of the total ingredient weight of said dispersion, mixture and said extractant liquid.

4. The method of claim 3 wherein said extractant mixture includes between about 5 to about 7 wt. % of said conventional charge control agent.

5. The method of claim 4 wherein said extractant mixture added pursuant to said Step (ii) comprises between about .5 to about 1.0 wt. % of the total ingredient weight of said dispersion and said extractant mixture.

6. The method of claim 1, wherein the physical separation of said Step (iv) is done by decantation.

7. The method of claim 1, wherein the physical separation of said Step (iv) is done by skimming procedures.

8. The method of claim 1, wherein said colorant material of said colorant constituent is comprised of an inorganic pigment.

9. The method of claim 1, wherein the extractant mixture added pursuant to said Step (ii) comprises between about .25 and about 5 wt. % of the total ingredient weight of said dispersion and said extractant mixture.

10. The method of claim 9 wherein said extractant liquid added pursuant to said Step (iii) comprises between about .5 to about 1.0 wt. % of the total ingredient weight of the water, dispersed toner and extractant vehicle.

11. The method of claim 1, wherein both said mineral spirit solvent vehicle of said toner composition and the mineral spirit of said extractant mixture are substantially aliphatic mineral spirits.

12. The method of claim 1, wherein said Step (iii) is allowed to proceed until substantially if not entirely all of said colorant constituent is attracted to said extractant mixture.

13. The method of claim 1, followed by the additional separate step of: (v) recovering the mineral spirit constituent from the emulsified remainder of the colorant-freed original toner concentrate composition subjected to the treatment.

14. The method of claim 1, followed by the additional separate step of: (vi) recovering the mineral spirit of said extractant mixture from the colorant material which said extractant mixture had removed from said toner composition subjected to the treatment.

15. The method of claim 1 wherein said extractant mixture includes between about 5 to about 7 wt. % of said conventional charge control agent.

* * * * *

UNITED STATES PATENT AND TRADEMARK OFFICE

CERTIFICATE OF CORRECTION

PATENT NO. : 4,052,298
DATED : October 4, 1977
INVENTOR(S) : Edward T. Bradley

It is certified that error appears in the above-identified patent and that said Letters Patent are hereby corrected as shown below:

Column 6, line 32:
"and said extractant liquid" should be --and said extractant mixture--
Column 6, line 54:
"liquid" should be --mixture--
Column 6, line 54:
"(iii)" should be --(ii)--
Column 6, line 56:
"the water, dispersed toner" should be --said dispersion--
Column 6, line 57:
"vehicle" should be --mixture--

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*